US010639240B2

(12) United States Patent
Tran et al.

(10) Patent No.: US 10,639,240 B2
(45) Date of Patent: May 5, 2020

(54) FEEDING NIPPLE SYSTEMS FOR CLEFT PALATE OR LIP

(71) Applicant: University of Virginia Patent Foundation, Charlottesville, VA (US)

(72) Inventors: Thanh Tran, Rocky Mount, VA (US); Marcelle Huizenga, Arlington, VA (US); Katrina Shah, Lorton, VA (US); Catherine Pelland, Charlottesville, VA (US); Katherine R. Knaus, Charlottesville, VA (US); Kathleen Borowitz, Charlottesville, VA (US); Silvia Blemker, Charlottesville, VA (US)

(73) Assignee: University of Virginia Patent Foundation, Charlottesville, VA (US)

( * ) Notice: Subject to any disclaimer, the term of this patent is extended or adjusted under 35 U.S.C. 154(b) by 40 days.

(21) Appl. No.: 15/568,842

(22) PCT Filed: Apr. 22, 2016

(86) PCT No.: PCT/US2016/028981
§ 371 (c)(1),
(2) Date: Oct. 24, 2017

(87) PCT Pub. No.: WO2016/172580
PCT Pub. Date: Oct. 27, 2016

(65) Prior Publication Data

US 2018/0110682 A1 Apr. 26, 2018

Related U.S. Application Data

(60) Provisional application No. 62/152,784, filed on Apr. 24, 2015.

(51) Int. Cl.
*A61J 11/00* (2006.01)
*A61J 11/04* (2006.01)

(52) U.S. Cl.
CPC ..... *A61J 11/005* (2013.01); *A61J 11/002* (2013.01); *A61J 11/006* (2013.01); *A61J 11/0015* (2013.01); *A61J 11/04* (2013.01)

(58) Field of Classification Search
CPC .... A61J 11/005; A61J 11/0045; A61J 11/002; A61J 11/001; A61J 11/006; A61J 11/045; A61J 11/04
(Continued)

(56) References Cited

U.S. PATENT DOCUMENTS 1,672,734 A * 6/1928 Reilly ..... A61J 11/00 215/11.1
1,999,581 A * 4/1935 Yager ..... A61J 9/04 215/11.5
(Continued)

FOREIGN PATENT DOCUMENTS

| | | |
|---|---|---|
| EP | 1779833 | 3/2014 |
| WO | WO 03/092577 | 11/2003 |
| WO | WO 2012/162465 | 11/2012 |

OTHER PUBLICATIONS

Campbell et al., "New feeder for infants with cleft palate", Archives of Disease in Childhood, 1987, pp. 1292-1293, vol. 62.

*Primary Examiner* — Robert J Hicks
(74) *Attorney, Agent, or Firm* — Robert J. Decker

(57) ABSTRACT

An apparatus including artificial nipple for feeding a baby who has a cleft in its palate region. The artificial nipple includes a palate region to define a region facing the baby's palate during use, and the nipple having a tongue region to define a region facing the baby's tongue during use. The palate region is less compliant than the tongue region to both mimic the hard palate and reduces unwanted movement of the nipple, making it easier for the infant to use his or her tongue to expel fluid from the nipple. The tongue region includes a feeding slit, which maybe U or V shaped, from
(Continued)

which liquid maybe discharged without risking nasal congestion. The tongue region may further include a soft protrusion, that assists the peristaltic like tongue movement helping the baby feed, and may extend laterally to reduce the risk of nasal congestion.

17 Claims, 12 Drawing Sheets

(58) Field of Classification Search
USPC ..... 215/11.4, 11.5, 11.1; 220/367.1; 222/562, 571, 570, 568, 567, 566
See application file for complete search history.

(56) References Cited

U.S. PATENT DOCUMENTS 2,537,583 A * 1/1951 Griesinger ..... A61J 11/02 215/11.1
2,816,547 A * 12/1957 Irwin ..... A61J 11/045 215/11.1
2,831,484 A * 4/1958 Garner ..... A61J 11/00 215/11.1
2,987,208 A 6/1961 Ransom
3,424,157 A * 1/1969 Di Paolo ..... A61J 11/001 215/11.4
3,777,753 A * 12/1973 Kesselring ..... A61J 11/045 215/11.1
4,632,263 A * 12/1986 Gertzman ..... A61J 11/045 215/11.1
4,834,099 A * 5/1989 Schrooten ..... A61J 11/004 215/11.1
4,856,663 A * 8/1989 Epp ..... A61J 11/00 215/11.1
5,791,503 A * 8/1998 Lyons ..... A61J 9/00 215/11.1
6,745,912 B2 * 6/2004 Uehara ..... A61J 11/006 215/11.1
6,991,122 B2 * 1/2006 Holley, Jr. ..... A61J 11/001 215/11.1
7,909,187 B2 * 3/2011 Montgomery ..... A61J 9/001 215/11.1
9,161,886 B2 10/2015 Haberman
2004/0220618 A1 * 11/2004 Rohrig ..... A61J 11/0035 606/234
2005/0224443 A1 * 10/2005 Raymond ..... A61J 9/001 215/11.1
2006/0175278 A1 * 8/2006 Schlumpf ..... A61J 11/0015 215/11.1
2007/0272645 A1 * 11/2007 Ito ..... A61J 11/005 215/11.1
2010/0314347 A1 * 12/2010 Haberman ..... A61J 9/04 215/6
2011/0100944 A1 * 5/2011 Van Der Kooi ..... A61J 11/001 215/11.1
2011/0226720 A1 * 9/2011 Rieppel ..... A61J 9/00 215/11.1
2013/0200029 A1 * 8/2013 Anderson ..... A47G 21/185 215/11.1

* cited by examiner

MEAD JOHNSON® NURSER

RESPIRONICS PHILLIPS® PIGEON BOTTLE

DR. BROWN® BOTTLE WITH SPECIALIZED CLEFT VALVE

HARBERMAN® FEEDER

FEEDING NIPPLE SYSTEMS FOR CLEFT PALATE OR LIP

RELATED APPLICATIONS

The present application is a national stage filing of International Application No. PCT/US2016/028981, filed Apr. 22, 2016, which claims benefit of priority under 35 U.S.C. § 119 (e) from U.S. Provisional Application Ser. No. 62/152,784, filed Apr. 24, 2015, entitled "Feeding Nipple Systems Specialized for Subjects with Cleft Palate or Cleft Lip & Palate and Related Method;" the disclosures of which are hereby incorporated by reference herein in their entirety.

FIELD OF THE INVENTION

The present invention relates generally to the field of feeding devices used for infants. More specifically, the invention is in the subfield of feeding devices used for children with cleft palate or other medical issues which hinder the child's ability to feed using negative pressure.

BACKGROUND

Children with cleft palate (CP) have difficulty feeding due to the inability to generate negative pressure in the mouth in order to draw milk out of the bottle. According to the Centers for Disease Control and Prevention, this birth defect affects 1 in 700 infants world-wide. Prior to corrective surgery, the simple task of feeding is a burden for both the child and parent (or care provider).

The present inventors recognized that current bottle designs specialized for CP are lacking due to the poorly understood mechanics of bottle feeding in these children. An aspect of an embodiment of the present invention provides, but not limited thereto, an improved, more effective bottle developed in order to provide an intermediate solution to affected children and parents (or care providers). Currently there are several bottles designed for babies with cleft palate or lip, such as the Haberman Feeder, Pigeon Bottle, and Mead Johnson. However, the present inventors recognized that a major problem, among others, with these bottles is that the flow rate is inconsistent and is significantly lower when compared to standard baby bottles such as the Avent Classic bottle and the Nuk Orthodontic bottle. This inconsistency comes from the parent (or care provider) having to control the flow rate by squeezing the bottle and a lack of communication between parent (or care provider) and child. This often results in longer feeding times for the parent (or care provider), resulting in the infant not consuming enough nutrients required for proper growth. The present inventors recognized that another issue is the cost and accessibility of each of these specialized bottles. These bottles can range anywhere from $20 (Mead Johnson nurser) to above $100.00 (Respironic Pigeon Specialty Feeding bottle) and can often only be found online or specially ordered. Some of the specialized bottles such as Haberman or the Pigeon nipple also come with one-way valve system which is hard to clean, assemble and disassemble. It also costs more to buy replacement since the bottle cannot be used without the missing piece. An aspect of an embodiment of the present invention provides, but not limited thereto, a design that addresses these problems by (among other reasons) allowing the baby to have control of the fluid flow.

SUMMARY

An aspect of various embodiments of the present invention bottle and related components may provide a number of advantages and novel and nonobvious features. For example, a first advantage, regarding an aspect of an embodiment, is the flow control mechanism. Rather than requiring complex buttons, tubes, or one-way valve systems that is present in many current designs, an aspect of an embodiment of the present invention design uses a flow control mechanism that may be a single solid or hollow piece without any moving parts, making it easier for cleaning and installation. Additionally, the current flow control devices are not designed with cleft palate or lip in mind, where the associated fluid flow rate is often directly related to the amount of negative pressure generated by the sucking action of the infant. However, infants with a cleft palate have extreme difficulty in generating the need negative pressure because the cleft in the infant's hard palates prevents the infant from forming a seal around the nipple. Some of the main advantages of the flow control mechanisms are, but not limited thereto, that it does not require any tedious work to use or assemble, and that it can be easily modified to fit various existing bottle designs simply by changing its diameter.

Furthermore, the flow control mechanisms are easy interchangeable with flow control mechanisms of a different design or pattern as to allow the parent or care taker to adjust the flow of the bottle to the needs and age of the child.

A second novel aspect of an embodiment of the present invention is the change of cut location and cut shape on the nipple. The typical location of a cut is on the head of the nipple. However, an aspect of an embodiment of the present invention provides, but not limited thereto, a design that places the cut on the tongue-region (the region of the nipple oriented towards the infant's tongue during feeding) of the nipple so that fluid will flow out easier due to gravity. By placing the cut on the tongue-region the nipple, there is a smaller chance that fluid will enter the nasal cavity thus preventing nasal regurgitation. In addition, rather than using the typical slit cuts such as the cross cut, the Y-cut, and a hole cut, an aspect of an embodiment of the present invention design uses the new carrot-cut ("^"), V-cut slit opening or U-cut, which may also be an upside down U-cut. The carrot-cut, V-cut opening, U-cut, or upside down U-cut allows the infant to expel milk from the bottle by applying pressure instead of sucking, making it easier for the infant to get the necessary amount of milk and nutrients.

Thirdly, regarding an aspect of an embodiment, the nipple is configured in a way that is specific to babies with cleft lip or palate. The top portion of the nipple includes a hard gel like filling. This both mimics the hard palate and reduces unwanted movement of the nipple, making it easier for the infant to use his or her tongue to expel fluid from the nipple. On the tongue-region (the region of the nipple oriented towards the infant's tongue during feeding) of the nipple is a soft pocket, or protrusion. This pocket, or protrusion, assists the peristaltic like tongue movement. As the tongue moves anterior to posterior, the pocket, or protrusion, reacts in-kind to the posterior-to-anterior movement further opening the slit and dispensing fluid. Also, the tongue-region of the nipple may extend laterally which would help direct the flow out from the nipple cut which further helps reduce the chance that fluid will enter the nasal cavity thus preventing nasal regurgitation.

An aspect of various embodiments of the present invention may be utilized for a number of products and services, such as but not limited thereto, some of the following. For example, an aspect of an embodiment of the present invention design will make the feeding process more efficient by reducing feeding times while increasing intake of milk and nutrients by the baby. This will result in improved physical growth and development of the child, which normally rests below the average on pediatric growth charts. The prevalence of cleft lip and palate varies based on ethnicity, country, and socioeconomic status. Therefore, market size will vary, but a market still exists for the technology disclosed herein. There is a want and need for an improved CP bottle feeding mechanism. With this product, the quality of life for the affected infant would increase during the period of time before reconstructive surgery can be considered. For example, in an approach, the present inventors can primarily focus on the U.S. market (infants from 0-10 months), however this design also has great potential in other countries, both developed and developing. In countries where reconstructive surgery might not be as readily available or affordable, a less expensive bottle (relative to a surgical procedure) specialized for infants with CP can help families that seem to have no other options. In this case, the design of various embodiments of the present invention would be invaluable to the development of cleft palate children. Due to the advantage of the new bottom flow control mechanisms associated with various embodiments of the present invention, these feeding system can also be used for other babies with severe feeding problems such as Down's Syndrome, Pierre Robin syndrome, neurological dysfunction, bronchopulmonary dysplasia, congenital heart disease, genetic disorders, disorganized sucking problems, excessive air intake during feeding and oral and facial abnormalities. Studies from Center of Disease Control and Prevention (CDC) shows that, each year in United State alone, there are 6000 diagnoses of Down's syndrome. At the same time, nearly 1% of—or about 40,000—births per year in the United States is also diagnosed with congenital heart disease. With the high need for child care, the market of this product as disclosed in the various embodiments disclosed herein can even be expanded for regular usage.

According to one embodiment of the invention, the artificial nipple has a distal end to define an end directed to the baby's mouth during use and a proximal end to define an end away from baby's mouth during use. Furthermore, the artificial nipple has a palate region to define a region facing the baby's palate during use, and a tongue region to define a region facing the baby's tongue during use. The palate and tongue regions have a wall, wherein the palate region wall its structured to be less compliant than the tongue wall. The tongue region also includes a feeding aperture that opens in response receiving pressure from the tongue of the baby.

In another embodiment of the invention, the artificial nipple may also include a protrusion located adjacent to the feeding aperture toward the proximal end. In yet another embodiment of the invention the protrusion may be more compliant than the tongue wall. In some other embodiments of the invention the protrusion may fill (inside the nipple) with fluid (e.g., feeding material) from the flood reservoir.

In another embodiment of the invention, the feeding aperture may be a slit.

In yet another embodiment of the invention the feeding aperture may be either a U or V shape, and the U and V may be either right side up or reversed (upside down).

In another embodiment of the invention, there may be a flow control mechanism in fluid communication with the nipple. A person having reasonable skill in the art will be able to derive numerous methods to have the flow control mechanism in fluid communication with the nipple. For example, but limited to, the flow control mechanism may be inserted into the proximal end of the nipple or the flow control mechanism may be part of the fluid reservoir connector.

In a more specific embodiment the flow control mechanism may be either a nozzle or a valve.

In another embodiment of the invention the proximal end may be connected to a fluid reservoir. In yet another embodiment of the invention the distal end may be configured as an enclosed surface.

In another embodiment of the invention the distal end may be configured to have a top region. The tip region is divided into a palate region tip region and a tongue region tip region, wherein the tongue region tip region may extend laterally outward to help direct the flow out from the feeding aperture.

In another embodiment of the invention the cross section of the nipple extending longitudinally between the distal end and proximal end may have varying cross section to simulate the anatomical features of a breast.

In another embodiment of the invention the embodiment is a kit including the artificial nipple together with a fluid reservoir and/or a fluid reservoir connector.

An aspect of an embodiment of the present invention provides, but not limited thereto, an artificial nipple for feeding a baby. The nipple may comprise: the nipple having a distal end to define an end directed to the baby's mouth during use, the nipple having a proximal end to define an end away from baby's mouth during use, whereby the distal end and the proximal are defined to be separated longitudinally from one another, the nipple having a palate region to define a region of nipple facing the baby's palate during use, and the nipple having a tongue region to define a region of nipple facing the baby's tongue during use. The palate region includes a wall and the tongue region includes a wall, wherein the palate wall has configuration whereby its structure is less compliant than the tongue wall. The tongue wall includes a feeding aperture, wherein the feeding aperture is configured to be opened upon receiving pressure exerted by the tongue of the baby to allow the feeding material to pass from inside the artificial nipple through the feeding aperture to the baby's mouth.

An aspect of an embodiment of the present invention provides, but not limited thereto, an apparatus including artificial nipple for feeding a baby who has a cleft in its palate region. The artificial nipple includes a palate region to define a region facing the baby's palate during use, and the nipple having a tongue region to define a region facing the baby's tongue during use. The palate region is less compliant than the tongue region to both mimic the hard palate and reduces unwanted movement of the nipple, making it easier for the infant to use his or her tongue to expel fluid from the nipple. The tongue region includes a feeding slit, which maybe U or V shaped, from which liquid maybe discharged without risking nasal congestion. The tongue region may further include a soft protrusion, that assists the peristaltic like tongue movement helping the baby feed, and may extend laterally to reduce the risk of nasal congestion. Additionally, the apparatus may include an interchangeable flow device to be used with the nipple that controls or regulates the flow of liquid to be adjusted for the needs of the child.

These and other objects, along with advantages and features of various aspects of embodiments of the invention disclosed herein, will be made more apparent from the description, drawings and claims that follow.

BRIEF DESCRIPTION OF THE DRAWINGS

The foregoing and other objects, features and advantages of the present invention, as well as the invention itself, will be more fully understood from the following description of preferred embodiments, when read together with the accompanying drawings The accompanying drawings, which are incorporated into and form a part of the instant specification, illustrate several aspects and embodiments of the present invention and, together with the description herein, serve to explain the principles of the invention. The drawings are provided only for the purpose of illustrating select embodiments of the invention and are not to be construed as limiting the invention.

DETAILED DESCRIPTIONS OF EXEMPLARY EMBODIMENTS

Exemplary modes and embodiments of this invention are described in detail below with reference to the accompanying drawings.

Here, the modes and embodiments to be described in the following specific examples of the invention so that technical features are associated therewith. However, the scope of the invention should not be limited to those exemplary modes.

Figure 1:
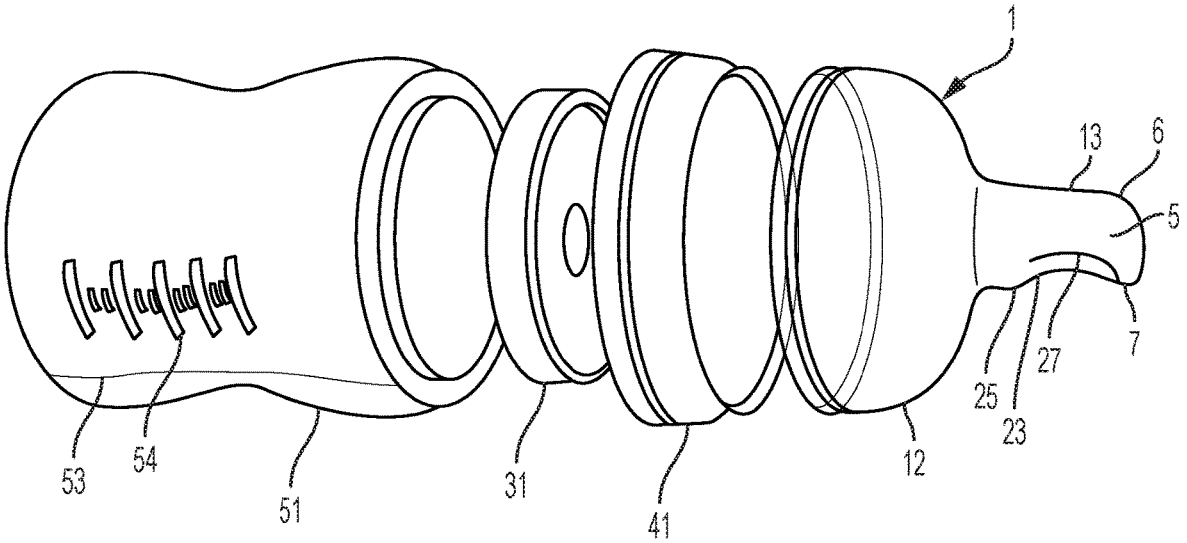
FIG. 1 is an exploded view showing the artificial nipple, flow control mechanism, and fluid reservoir according to a generalized embodiment of the present invention.

In specific reference to FIG. 1 one can see one exemplary embodiment of the invention. In this exemplary embodiment the artificial nipple 1 whose outlines are walls, is connected by a fluid reservoir connector (e.g. a collar) 41, to a fluid reservoir, 51 (e.g., feeding material reservoir). The fluid reservoir 51 may contain feeding material, or other fluid 53. Furthermore, the reservoir 51 may have measurement graduations 54. The flow rate of fluid from the fluid reservoir 51 to the artificial nipple 1 maybe augmented by the presence of a flow control mechanism (e.g. a nozzle) 31 which may be, but is not limited to being, fitted inside of the fluid reservoir connector 41 or may be fitted directly into the artificial nipple 1. The placement of the flow control mechanism 31 provided above are merely examples and are not intended to limit the scope of the invention, as a person having reasonable skill in the art may create a multitude of other methods to have the flow control mechanism remain in fluid communication with the nipple.

The artificial nipple 1 may also have a base 12 (can be wide or narrow, tall or low profile, or any combination of the aforementioned). The artificial nipple 1 may also have a tongue region 23, which is the region facing the baby's tongue during use. On the tongue region 23 there may be a feeding aperture (e.g., slit or groove) 27 from which fluid may be discharged from during feeding. Also, the tongue region 23 may further include a protrusion (e.g., bump) 25, which when receiving tactile pressure (e.g. force from the infant's tongue or gums) helps open the feeding aperture 27. In some exemplary embodiments of the invention, the protrusion 25 is more compliant than the surrounding tongue wall. As a resulted the amount of force required from the infant to help open the feeding aperture 27 is reduced. This protrusion 25, or pocket, assists and responds to the peristaltic like tongue movement. As the tongue moves anterior to posterior, then the protrusion, or pocket, reacts in-kind to the posterior-to-anterior movement further opening the feeding aperture 27 (e.g., slit) and dispensing fluid. The protrusion may also fill with fluid 53 (e.g., feeding material) from the fluid reservoir 51 (e.g., feeding material reservoir) at the tongue-side of the nipple (inside the nipple) where maximal contact force of the tongue movement will occur. Furthermore, the tongue force may cause the protrusion to move inward and with the release of tongue pressure on the protrusion relaxes and returns to a position when forces are not applied. In this exemplary embodiment of the invention the feeding aperture, 27, is a U-shaped slit, however this does not limit the scope of the feeding aperture design. Alternatively, the feeding aperture, 27, can be V-shaped, or a V-shape rotated 180 degrees so as to be "Carrot" shaped. These alternative designs are merely provided as examples and do not limit the scope of the feeding aperture 27 as a person reasonably skilled in the art may create a number of alternative designs for the shape of the feeding aperture. According to an aspect of an embodiment the invention, the location of the feeding aperture 27 on the tongue region 23, as opposed to the tip region as seen in prior art, reduces the chance that fluid will enter the nasal cavity thus preventing nasal regurgitation.

Furthermore, the artificial nipple 1 may also have a palate region 13, which is the region facing the baby's palate during use. Additionally, the artificial nipple 1 may also have a tip region 5. The tip region 5 may be further divided into a tip-palate region 6 of the tip region 5 and a tip-tongue region 7 of the tip region 5. The tip-tongue region 7 of the tip region 5 may extend laterally (such as a protrusion or convex shape) in order to help direct the fluid discharged from the feeding aperture 27 and further reduce the chance that fluid will enter the nasal cavity thus preventing nasal regurgitation.

Figure 2:
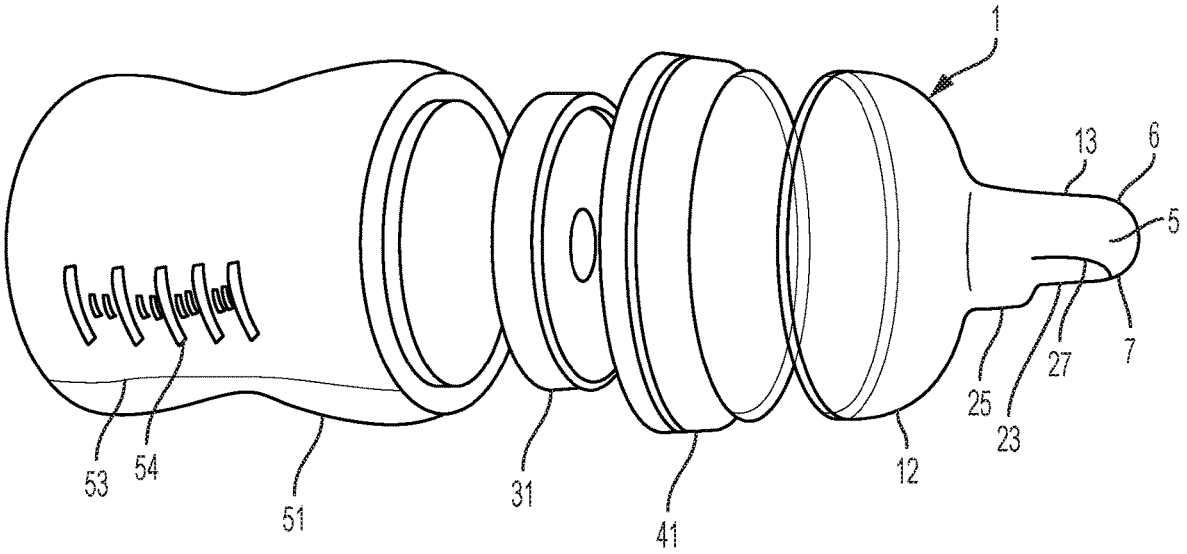
FIG. 2 shows the same exploded view as FIG. 1 with an alternative designed artificial nipple.

In specific reference to FIG. 2 one can see an alternative exemplary embodiment of the invention. In this exemplary embodiment, the tip-tongue region 7 of the tip region 5 does not extend laterally, more closely resembling traditional artificial nipple design (as it pertains to this specific contour). Furthermore, this exemplary embodiment shows that the protrusion 25 may be of various aesthetical or functional designs (e.g. spherical or ellipsoid).

Figure 3:
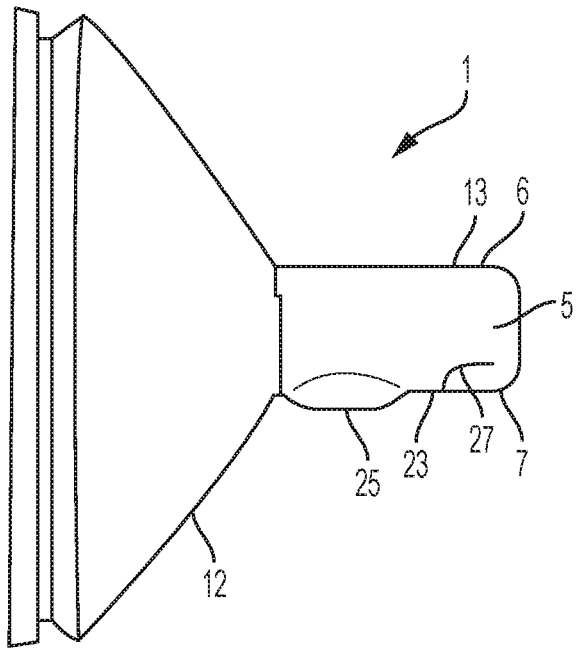
FIG. 3 is a horizontal side view of the artificial nipple.

In specific reference to FIG. 3 one can see yet another exemplary embodiment of the artificial nipple 1. This alternative exemplary embodiment shows that the base, 12 may also be of various aesthetical or functional designs, as well as modifications to meet the anatomical considerations of a natural breast. This exemplary embodiment of the invention may also have a portion of the palate region wall 13 that is less compliant than the wall of the tongue region 23. The reduction in compliancy may be achieved by, but is not limited to, increasing the thickness of the wall for the portion or the presence of a hard gel within the wall. Other materials or structures may be implemented to achieve desired or required level of compliancy. A person reasonably skilled in the art may create numerous alternative means to achieve a reduction in compliancy. As a result of the reduced compliancy this exemplary embodiment of the invention better mimics the hard palate and reduces unwanted movement of the nipple, making it easier for the infant to use his or her tongue to expel fluid from the nipple.

Figure 4:
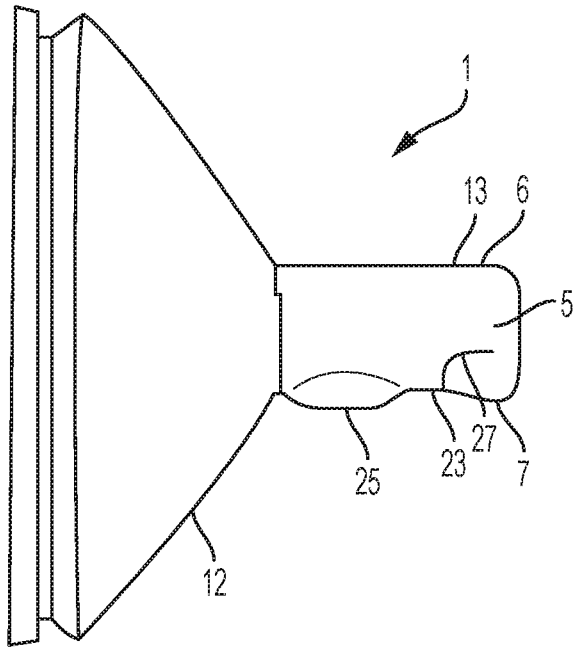
FIG. 4 is a horizontal side view of an alternative design of the artificial nipple.

In specific reference to FIG. 4 one can see an alternative exemplary embodiment of the invention in which the tip-tongue region 7 of the tip region 5 is laterally extended (such as a protrusion or convex shape). As mentioned this helps direct the fluid discharged from the feeding aperture 27, and reduces the chance that fluid will enter the nasal cavity thus preventing nasal regurgitation. Furthermore, in this alternative exemplary embodiment of the invention the feeding aperture 27 is turned upward. The orientation of the feeding aperture 27 is merely provided as an example, and is not intended to limit the scope of the invention. A person having reasonable skill in the art may determine numerous other orientations for the feeding aperture 27.

Figure 5:
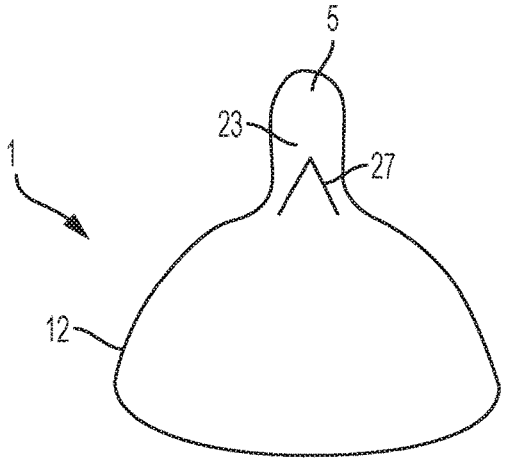
FIG. 5 is a vertical side view of the artificial nipple with a carrot cut.
Figure 6:
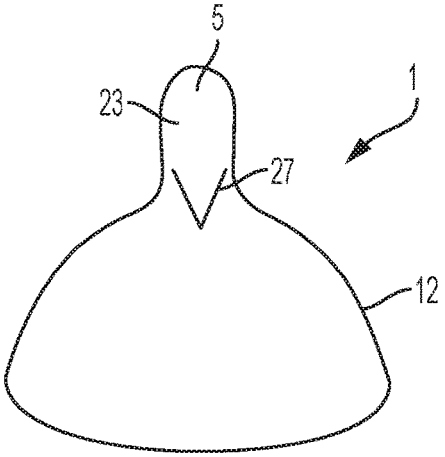
FIG. 6 is a vertical side view of the artificial nipple with a v cut.

In specific reference to FIG. 5 one can see the side view of an exemplary embodiment of the artificial nipple 1 wherein the feeding aperture 27 is V-shaped. FIG. 6 shows an alternative an exemplary embodiment of the artificial nipple 1, wherein the wherein the feeding aperture 27 is "carrot" shaped (i.e., upside down "V"). FIG. 5 and FIG. 6 illustrate that there are multiple different aesthetic or functional designs for the feeding aperture 27, however, these are not the only possible designs for the feeding aperture 27 and nothing in the drawings should limit the scope of the designs for the feeding aperture, 27.

Figure 7:
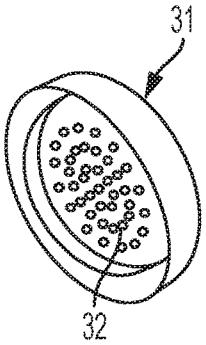
FIG. 7 is a perspective view (from the underside) of a sprinkler design flow control mechanism.
Figure 8:
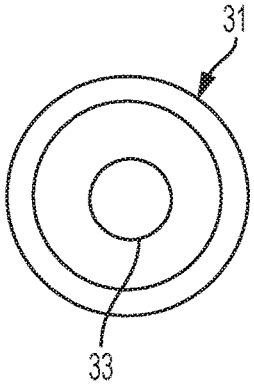
FIG. 8 is an end view (from the underside) of a funnel design flow control mechanism.

In specific reference to FIG. 7 one can see the underside, perspective view, of an exemplary embodiment of the flow control mechanism, 31. In this exemplary embodiment, the flow control mechanism 31 has a sprinkler orifice 32. Alternatively, FIG. 8 shows another exemplary embodiment, bottom view, of the flow control mechanism 31, which has a funnel orifice 33. Both FIG. 7 and FIG. 8 show only exemplary designs of the orifices and are not intended to limit the scope of the orifices.

Figure 9:
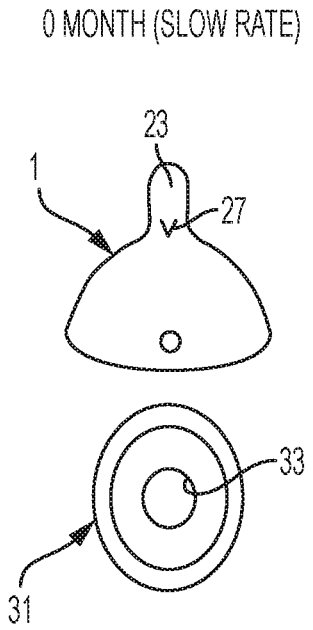
FIG. 9 shows the combination of flow control mechanism and artificial nipple for a slow flow rate.
Figure 10:
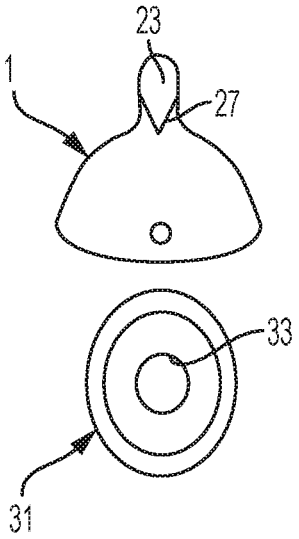
FIG. 10 shows the combination of flow control mechanism and artificial nipple for a medium flow rate.
Figure 11:
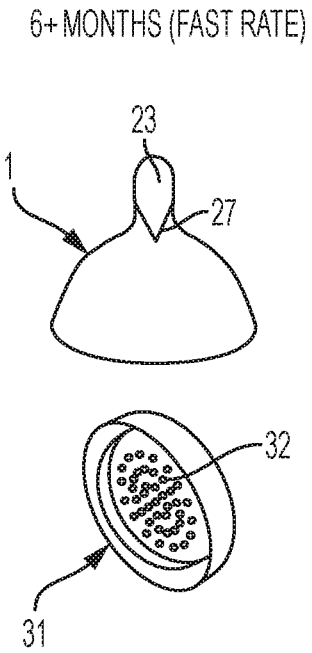
FIG. 11 shows the combination of flow control mechanism and artificial nipple for a fast flow rate.

FIGS. 9-11 show different exemplary embodiments of how different combinations of artificial nipples 1 and flow control mechanisms 31 maybe used to achieve different flow rates.

FIG. 9 shows the artificial nipples 1 with a small feeding aperture 27 and a flow control mechanism 31 with a funnel orifice 32, which in combination are used to achieve a flow rate of approximately 15 mL/min, ideal for a child aged 0-3 months.

FIG. 10 shows the artificial nipples 1 with a large feeding aperture 27 and a flow control mechanism 31 with a funnel orifice 32, which in combination are used to achieve a flow rate of approximately 38 mL/min, ideal for a child aged 3-6 months.

FIG. 11 shows the artificial nipples, 1, with a large feeding aperture 27 and a flow control mechanism 31 with a sprinkler orifice 33, which in combination are used to achieve a flow rate of approximately 61 mL/min, ideal for a child aged 6+ months.

Figure 20:
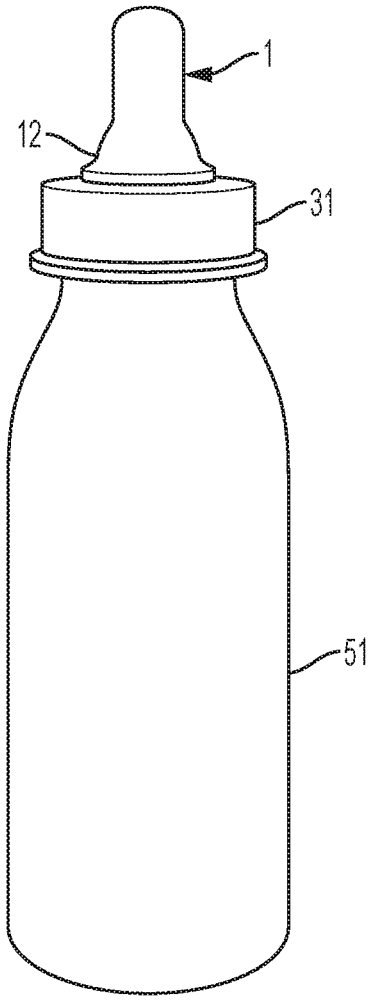
FIG. 20 shows a horizontal side view of the artificial nipple, fluid reservoir connector and fluid reservoir according to an alternative generalized embodiment of the present invention.

FIG. 20 shows an alternative exemplary embodiment of the invention. In this alternative exemplary embodiment of the invention the artificial nipple 1 has a narrow base 12. As a result of having the narrow base 12, the fluid reservoir 51 may also be narrow. This alternative exemplary embodiment of the invention illustrates that the base 12 and the fluid reservoir 51 may be of various aesthetical and functional designs. However, this alternative exemplary embodiment of the invention is merely provided as an example and is not intended to limit the scope of the invention. A person having reasonable skill in the art may develop numerous alternative designs to suit different needs (e.g. a wide base and fluid reservoir for increased stability or a narrow base and fluid reservoir for increased portability).

EXAMPLES

Practice of an aspect of an embodiment (or embodiments) of the invention will be still more fully understood from the following examples and experimental results, which are presented herein for illustration only and should not be construed as limiting the invention in any way.

Example and Experimental Results Set No. 1

Figure 12:
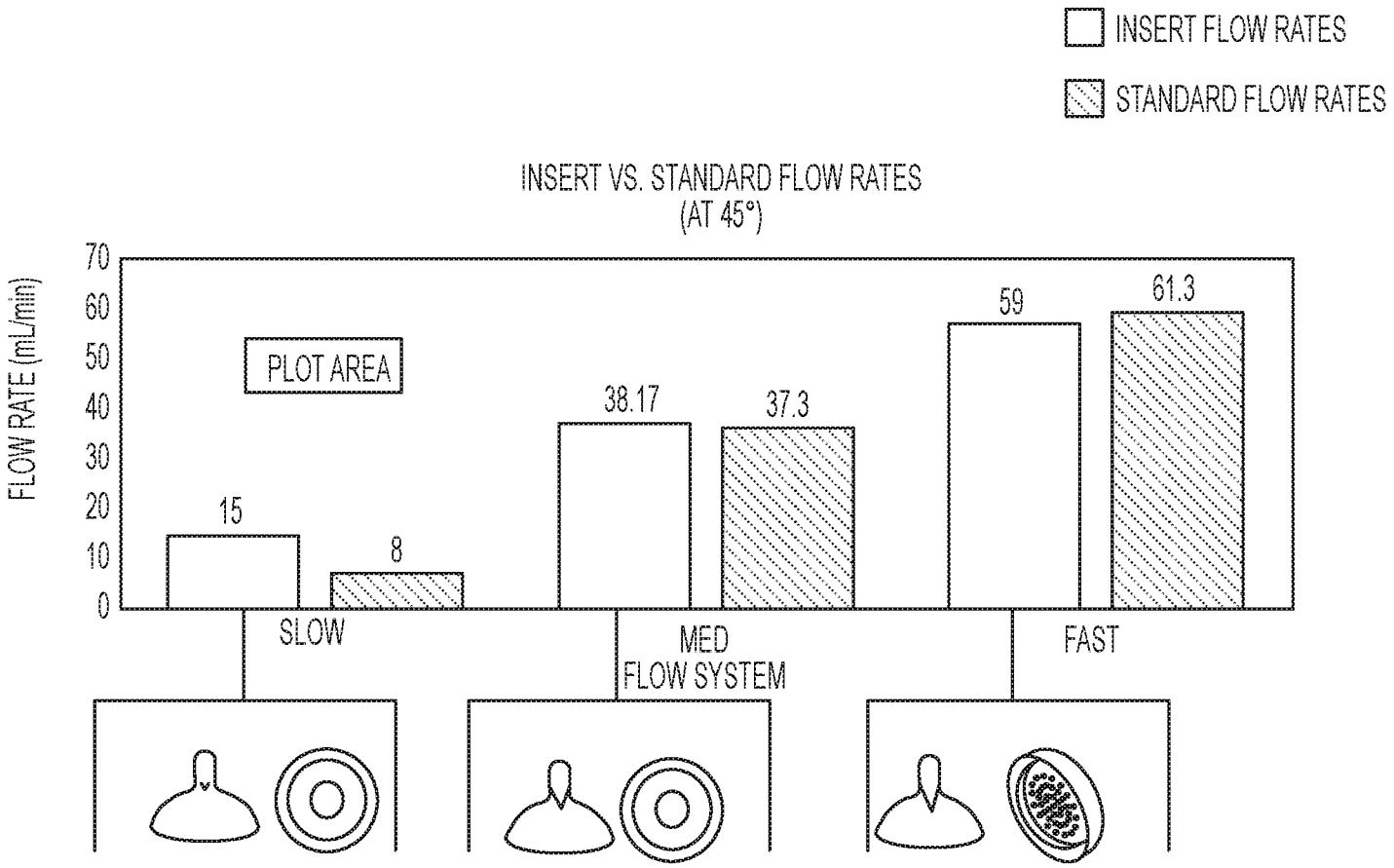
FIG. 12 shows a graph comparing the standard flows rates to the flows of an exemplary embodiment prototype from an experiment using a level testing system.
Figure 19:
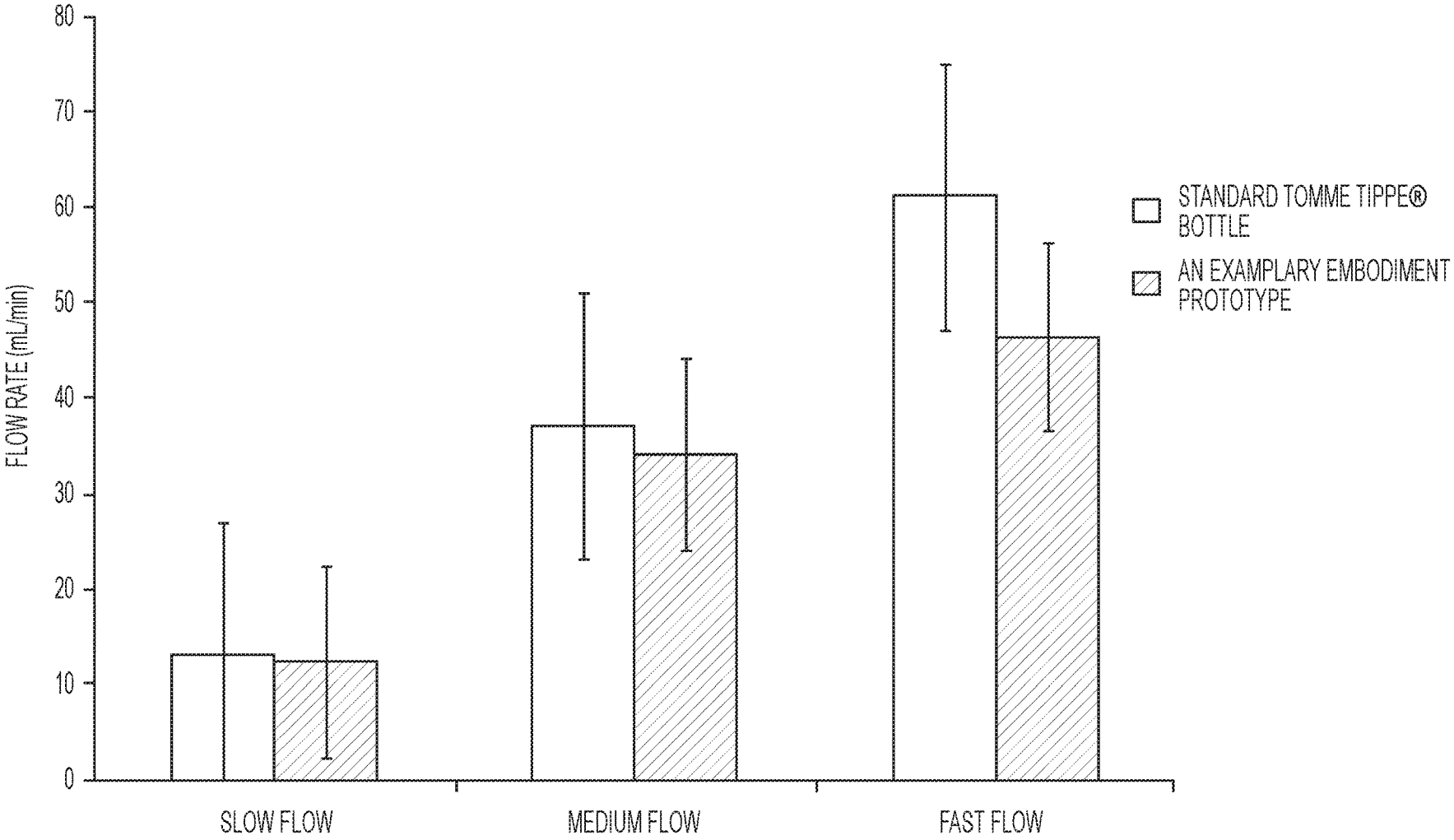
FIG. 19 shows a graph comparing the flow rates of a standard Tomme Tippe® bottle to an exemplary embodiment prototype from an experiment using a mechanical testing system.

FIG. 12 shows a comparison between the combinations show in FIGS. 9-11 and the flow rates of a standard artificial nipple. The results illustrated in FIG. 12 show that even with the numerous differences between an exemplary embodiment of the invention and a standard artificial nipple the flow rates are similar. FIG. 19 shows the average results of another experiment, using an alternative testing system, comparing the flows rates of an exemplary embodiment of the invention and a standard Tomme Tippe® bottle. Although FIG. 19 demonstrates a slightly higher difference in flow rates than FIG. 12 the flow rates are still comparable. These results are important because poor flow rates are a known problem of prior art artificial nipples designed for children with cleft palates.

Example and Experimental Results Set No. 2

Figure 13:
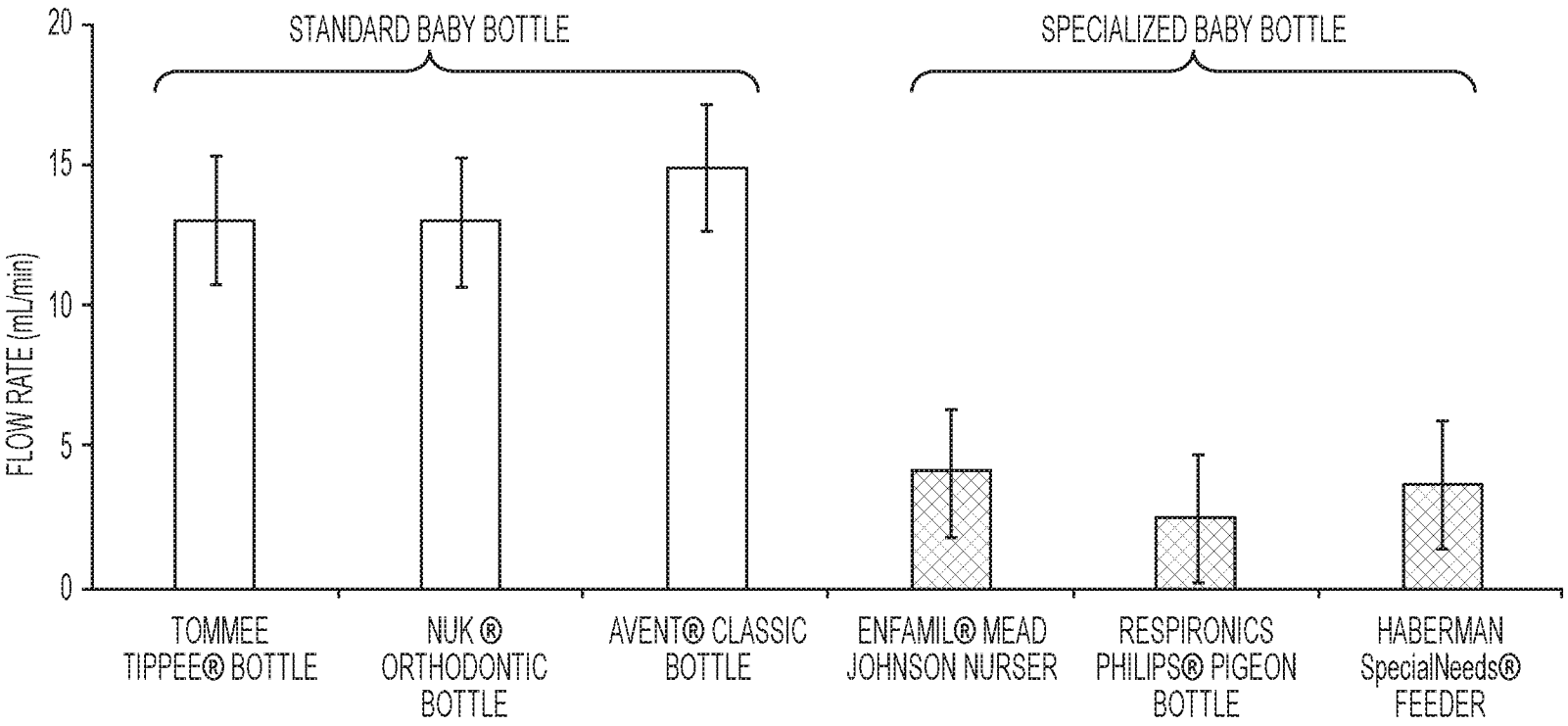
FIG. 13 shows a graph comparing the flow rates of standard baby bottles to specialty bottles designed for children with a cleft palate.
Figure 18:
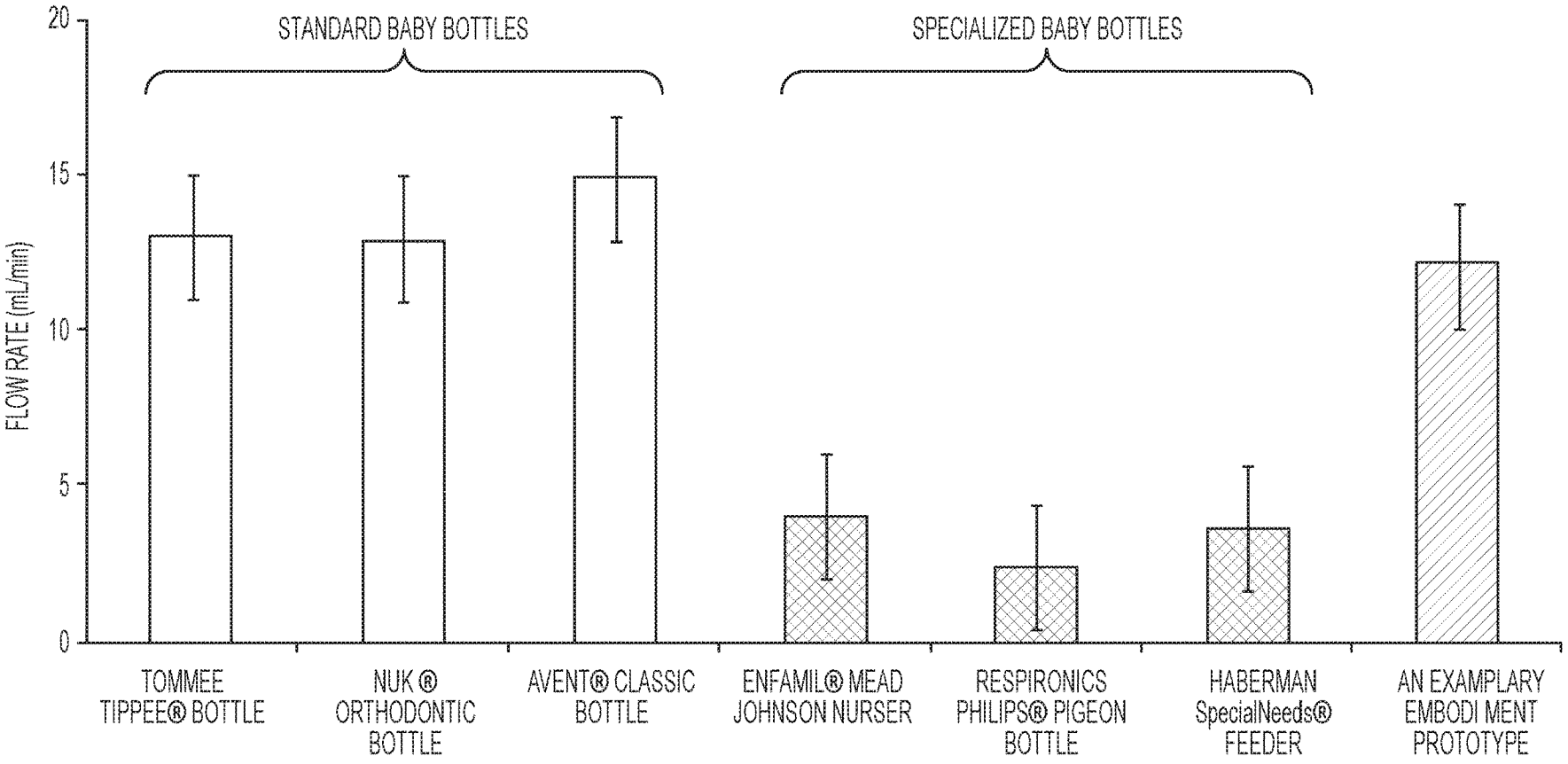
FIG. 18 shows a graph comparing the flow rates of standard baby bottles to specialty bottles designed for children with a cleft palate, and to an exemplary embodiment prototype.

As mentioned, poor flow rates are a know problem of prior art artificial nipples designed for children with cleft palates. FIG. 13 shows experimental results supporting this assertion, in regards to flow rates for children aged 0-3 months. The results show the average tested flow rates of three commonly use standard baby bottles and three commonly used bottles specialized for babies with cleft palates. The results demonstrate that the three specialized bottles have significantly reduced flow rates when compared to the standard bottles. FIG. 18 shows experimental results comparing the flow rates of standard baby bottles to specialty bottles designed for children with a cleft palate, and to an exemplary embodiment prototype. These results show that, unlike other specialized bottles for children with a cleft palate, the exemplary embodiment prototype has flow rates more consistent with standard bottles. Thus showing that the exemplary embodiment prototype addresses a major problem with specialty bottles designed for children with a cleft palate.

Example and Experimental Results Set No. 3

Figure 15:
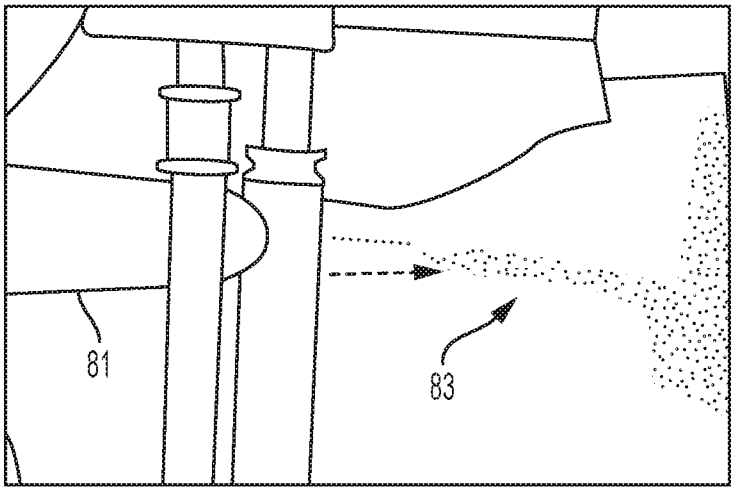
FIG. 15 shows the flow direction from a bottom view of a Mead Johnson® Nurser specialty bottle for children with a cleft palate.
Figure 14:
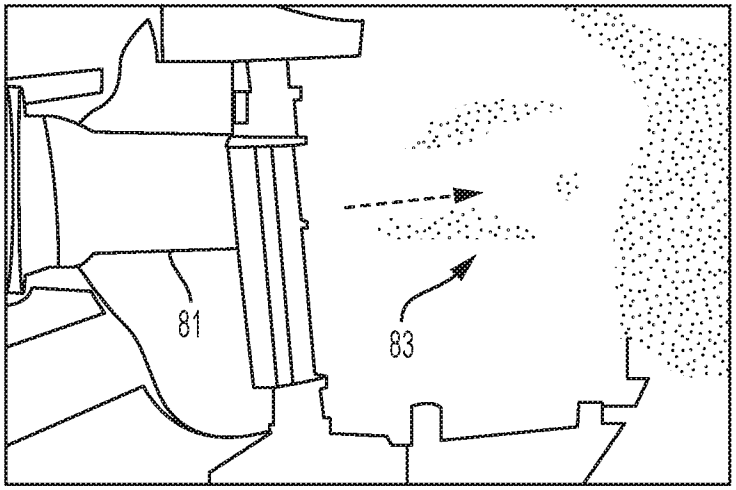
FIG. 14 shows the flow direction from a bottom view of a Phillips® Pigeon specialty bottle for children with a cleft palate.
Figure 17:
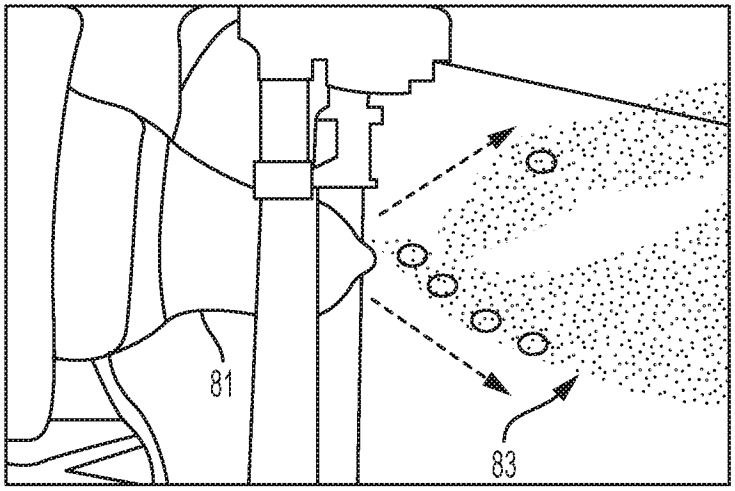
FIG. 17 shows the flow direction from a bottom view of a Dr. Brown® bottle with specialized cleft valve for children with a cleft palate.
Figure 16:
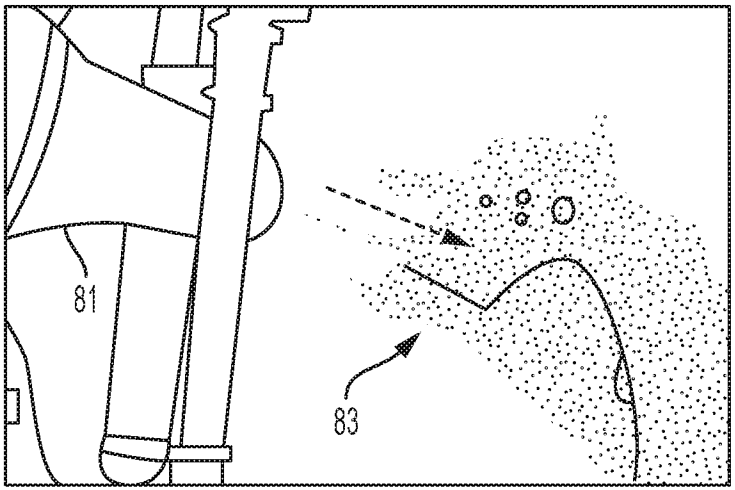
FIG. 16 shows the flow direction from a bottom view of a Harberman® Feeder specialty bottle for children with a cleft palate.

FIGS. 14-17 show the fluid projection patterns 83 (as generally show by the arrow and speckle pattern) of four common bottles specialized for babies with cleft palates, each projection pattern illustrates problems with the design of the specialized bottles with respective artificial nipples 81. As disclosed herein such problems are addressed by aspects of various embodiments of the invention. FIG. 14 shows the projection pattern of the Phillips® Pigeon bottle, and FIG. 15 shows the projection pattern of the Mead Johnson® Nurser. Both FIG. 14 and FIG. 15 show very directional fluid projection, and the fluid is consistently projected towards the back of the throat, which carries a low risk of nasal regurgitation. However, both FIG. 14 and FIG. 15 also show that only a small amount of liquid is projected, which is indicative of the slow flow rate issues that plague specialized bottles and are addressed by the design of the aspects of various embodiments of the invention. FIG. 16 shows the Harberman® Feeder, which also has very directional fluid projection and low flow rate. However, unlike FIG. 14 and FIG. 15, FIG. 16 shows that the angle of the projection can be pointed up into the nasal cavity causing some risk of nasal regurgitation, especially if the care taker lacks experience in use of the bottle. FIG. 17 shows the fluid projection of the Dr. Brown® bottle with specialized cleft valve. Unlike what is illustrated by FIGS. 14-16, FIG. 17 shows that the fluid projection of the Dr. Brown® bottle with specialized cleft valve is not directional, spraying in multiple directions at once. As a result, FIG. 17 illustrates why there is a high risk of nasal regurgitation with the Dr. Brown® bottle with specialized cleft valve. Numerous elements of the present invention are designed to address the issues of nasal regurgitation and low flow rates highlighted by FIGS. 14-17.

Additional Examples

Example 1. An artificial nipple for feeding a baby comprising: said nipple having a distal end to define an end directed to the baby's mouth during use, said nipple having a proximal end to define an end away from baby's mouth during use, whereby said distal end and said proximal are defined to be separated longitudinally from one another, said nipple having a palate region to define a region of nipple facing the baby's palate during use, and said nipple having a tongue region to define a region of nipple facing the baby's tongue during use. The palate region having a wall and said tongue region have a wall, wherein said palate wall has configuration whereby its structure is less compliant than the tongue wall. The tongue wall includes a feeding aperture, wherein said feeding aperture is configured to be opened upon receiving pressure exerted by the tongue of the baby to allow the feeding material to pass from inside said artificial nipple through said feeding aperture to the baby's mouth.

Example 2. The nipple of example 1, further comprising: a protrusion on said tongue wall, wherein said protrusion is located adjacent to said feeding aperture toward the proximal end.

Example 3. The nipple of example 2, wherein said protrusion is configured to be able to fill with the feeding material inside said nipple.

Example 4. The nipple of example 2 (as well as subject matter in whole or in part of example 3), wherein the structure of the protrusion is more compliant than the tongue wall.

Example 5. The nipple of example 1 (as well as subject matter of one or more of any combination of examples 2-4), wherein said feeding aperture is a slit.

Example 6. The nipple of example 1 (as well as subject matter of one or more of any combination of examples 2-5), wherein said feeding aperture is U shaped or V shaped.

Example 7. The nipple of example 1 (as well as subject matter of one or more of any combination of examples 2-6), further comprising said nipple provided in fluid communication with a flow control mechanism.

Example 8. The nipple of example 7 (as well as subject matter of one or more of any combination of examples 2-6), wherein said flow control mechanism is a nozzle or valve.

Example 9. The nipple of example 7 (as well as subject matter of one or more of any combination of examples 2-6 and 8), wherein: said proximal end of said nipple is configured to be in communication with a fluid-reservoir connector.

Example 10. The nipple of example 9 (as well as subject matter of one or more of any combination of examples 2-8), wherein said flow control mechanism is disposed on said fluid-reservoir connector.

Example 11. The nipple of example 9 (as well as subject matter of one or more of any combination of examples 2-8 and 10), wherein said flow control mechanism is disposed on said nipple.

Example 12. The nipple of example 1 (as well as subject matter of one or more of any combination of examples 2-11), wherein said proximal end of said nipple is configured to be connected to a fluid reservoir or fluid-reservoir connector.

Example 13. The nipple of example 1 (as well as subject matter of one or more of any combination of examples 2-12), wherein said distal end is configured as an enclosed surface tip.

Example 14. The nipple of example 1(as well as subject matter of one or more of any combination of examples 2-13), wherein the lateral cross section of the nipple along the longitudinal axis between the distal end and proximal end of the nipple may have varying lateral cross section to simulate the anatomical features of a breast.

Example 15. The nipple of example 1 (as well as subject matter of one or more of any combination of examples 2-14), wherein said distal end of the nipple is configured to have a tip region, wherein said tip region comprises a tip-palate region of tip region and tip-tongue region of tip region, and wherein said tip-tongue region of tip region extends laterally outward.

Example 16. The nipple of example 1 (as well as subject matter of one or more of any combination of examples 2-15), further comprising said nipple provided together with: a fluid reservoir; a fluid reservoir connector; or a fluid reservoir and a fluid connector.

Example 17. The nipple of example 16 (as well as subject matter of one or more of any combination of examples 2-15), wherein said fluid reservoir connector is configured to secure said nipple with said fluid reservoir.

Example 18. The nipple of example 16 (as well as subject matter of one or more of any combination of examples 2-15 and 17), further comprising said nipple provided together with: a flow control mechanism configured to be used in fluid communication with said nipple.

Example 19. The method of using or selling any of the systems (structures or devices) or their components (in whole or in part) provided in any one or more of examples 1-18.

Example 20. The method of manufacturing any of the systems (structures or devices) or their components (in whole or in part) provided in any one or more of examples 1-18.

REFERENCES

The devices, systems, apparatuses, structures, compositions, materials, and methods of various embodiments of the invention disclosed herein may utilize aspects disclosed in the following references, applications, publications and patents and which are hereby incorporated by reference herein in their entirety (and which are not admitted to be prior art with respect to the present invention by inclusion in this section):

1. U.S. Patent Application Publication No. US 2005/0224443 A1, Raymond, et al., "Nursing Bottle", Oct. 13, 2005.

2. U.S. Pat. No. 4,856,663, Epp, L., "Nursing Device for Infant with Cleft Lip or Cleft Palate", Aug. 15, 1989.

3. U.S. Pat. No. 7,909,187 B2, Montgomery, L., "Modular Baby Bottle System", Mar. 22, 2011.

4. U.S. Pat. No. 6,745,912 B2, Uehara, et al., "Artificial Nipple and a Feeding Bottle Having the Artificial Nipple", Jun. 8, 2004.

5. U.S. Pat. No. 4,632,263, Gertzman, G., "Nipple for a Baby who has a Cleft in its Hard Plate", Dec. 30, 1986.

6. U.S. Patent Application Publication No. US 2011/0226720 A1, "Baby Bottle with Enhanced Flow Characteristics", Rieppel, M., Sep. 22, 2011.

7. U.S. Pat. No. 6,991,122 B2, Holley, Jr., J., "Flow Control Element" "Including Elastic Membrane with Pinholes", Jan. 31, 2006.

8. International Patent Application Publication No. WO 03/092577 A1, Dunn, S., et al., "Variable Flow Infant Feeding Assembly", Nov. 13, 2003.

9. U.S. Pat. No. 3,424,157, Di Paolo, R., "Nursing Nipple with Flow-Regulating Means", Jan. 28, 1969.

10. U.S. Patent Application Publication No. US 2010/0314347 A1, Haberman, et al., "Feeding Apparatus", Dec. 16, 2010.

11. U.S. Patent Application Publication No. US 2007/0272645 A1, Ito, et al., "Artificial Nipple, Infant Feeding Device, and Artificial Nipple Manufacturing Method", Nov. 29, 2007.

12. U.S. Pat. No. 1,672,734, Reilly, C., "Nipple for Nursing Bottles", Jun. 5, 1928.

13. U.S. Pat. No. 1,999,581, Yager, H., "Combination Nursing Bottle and Nipple", Apr. 30, 1935.

14. European Patent Application Publication No. EP 1 779 833 A1, Ito, et al., "Artificial Nipple, Feeder, and Method of Producing Artificial Nipple", May 2, 2007.

15. Campbell, A., et al., "A Significant advance in the Feeding of Infants with Cleft Palates", Archives of Disease in Childhood, 1987, 62, pages 1292-1293, 15. U.S. Pat. No. 9,161,886 B2, Haberman, et al., "Feeding Apparatus", Oct. 20, 2015.

16. International Patent Application Publication No. WO 2012/162465 A1, Rieppel, M., "Feeding Assembly for a Baby Feeding Bottle with Enhanced Flow Characteristics", Nov. 29, 2012.

Unless clearly specified to the contrary, there is no requirement for any particular described or illustrated activity or element, any particular sequence or such activities, any particular size, speed, material, duration, contour, dimension or frequency, or any particularly interrelationship of such elements. Moreover, any activity can be repeated, any activity can be performed by multiple entities, and/or any element can be duplicated. Further, any activity or element can be excluded, the sequence of activities can vary, and/or the interrelationship of elements can vary. It should be appreciated that aspects of the present invention may have a variety of sizes, contours, shapes, compositions and materials as desired or required.

In summary, while the present invention has been described with respect to specific embodiments, many modifications, variations, alterations, substitutions, and equivalents will be apparent to those skilled in the art. The present invention is not to be limited in scope by the specific embodiment described herein. Indeed, various modifications of the present invention, in addition to those described herein, will be apparent to those of skill in the art from the foregoing description and accompanying drawings. Accordingly, the invention is to be considered as limited only by the spirit and scope of the following claims, including all modifications and equivalents.

Still other embodiments will become readily apparent to those skilled in this art from reading the above-recited detailed description and drawings of certain exemplary embodiments. It should be understood that numerous variations, modifications, and additional embodiments are possible, and accordingly, all such variations, modifications, and embodiments are to be regarded as being within the spirit and scope of this application. For example, regardless of the content of any portion (e.g., title, field, background, summary, abstract, drawing figure, etc.) of this application, unless clearly specified to the contrary, there is no requirement for the inclusion in any claim herein or of any application claiming priority hereto of any particular described or illustrated activity or element, any particular sequence of such activities, or any particular interrelationship of such elements. Moreover, any activity can be repeated, any activity can be performed by multiple entities, and/or any element can be duplicated. Further, any activity or element can be excluded, the sequence of activities can vary, and/or the interrelationship of elements can vary. Unless clearly specified to the contrary, there is no requirement for any particular described or illustrated activity or element, any particular sequence or such activities, any particular size, speed, material, dimension or frequency, or any particularly interrelationship of such elements. Accordingly, the descriptions and drawings are to be regarded as illustrative in nature, and not as restrictive. Moreover, when any number or range is described herein, unless clearly stated otherwise, that number or range is approximate. When any range is described herein, unless clearly stated otherwise, that range includes all values therein and all sub ranges therein. Any information in any material (e.g., a United States/foreign patent, United States/foreign patent application, book, article, etc.) that has been incorporated by reference herein, is only incorporated by reference to the extent that no conflict exists between such information and the other statements and drawings set forth herein. In the event of such conflict, including a conflict that would render invalid any claim herein or seeking priority hereto, then any such conflicting information in such incorporated by reference material is specifically not incorporated by reference herein.

We claim:

1. An artificial nipple for feeding a baby, said nipple comprising:

a distal end to define an end directed to the baby's mouth during use, said nipple having a proximal end to define an end away from baby's mouth during use, whereby said distal end and said proximal are defined to be separated longitudinally from one another, said nipple having a palate region to define a region of nipple facing the baby's palate during use, and said nipple having a tongue region to define a region of nipple facing the baby's tongue during use;

said palate region having a wall and said tongue region have a wall, wherein said palate wall has configuration whereby its structure is less compliant than the tongue wall;

wherein said distal end of the nipple is configured to have a tip region, wherein said tip region comprises a tip-palate region of said tip region and tip-tongue region of said tip region, and wherein said tip-tongue region of said tip region extends laterally outward;

said palate wall is longitudinally spaced, in a proximal direction, from said tip region, said tip-palate region, and said tip-tongue region;

said tongue wall is longitudinally spaced, in a proximal direction, from said tip region, said tip-palate region, and said tip-tongue region; and said tongue wall includes a feeding aperture configured to be oriented towards the infant's tongue during feeding, wherein said feeding aperture is longitudinally spaced, in a proximal direction, from said tip region, said tip-palate region, and said tip-tongue region and said feeding aperture is configured to be opened upon receiving pressure exerted by the tongue of the baby directly on said tongue wall to allow the feeding material to pass from inside said artificial nipple through said feeding aperture to the baby's mouth.

2. The nipple of claim 1, further comprising:

a protrusion on said tongue wall, wherein said protrusion is located adjacent to said feeding aperture toward the proximal end.

3. The nipple of claim 2, wherein said protrusion is configured to be able to fill with the feeding material inside said nipple.

4. The nipple of claim 2, wherein the structure of the protrusion is more compliant than the tongue wall.

5. The nipple of claim 1, wherein said feeding aperture is a slit.

6. The nipple of claim 1, wherein said feeding aperture is U shaped or V shaped.

7. The nipple of claim 1, further comprising said nipple provided in fluid communication with a flow control mechanism.

8. The nipple of claim 7, wherein said flow control mechanism is a nozzle or valve.

9. The nipple of claim 7, wherein:

said proximal end of said nipple is configured to be in communication with a fluid-reservoir connector.

10. The nipple of claim 9, wherein said flow control mechanism is disposed on said fluid-reservoir connector.

11. The nipple of claim 9, wherein said flow control mechanism is disposed on said nipple.

12. The nipple of claim 1, wherein said proximal end of said nipple is configured to be connected to a fluid reservoir or fluid-reservoir connector.

13. The nipple of claim 1, wherein said distal end is configured as an enclosed surface tip.

14. The nipple of claim 1, wherein the lateral cross section of the nipple along the longitudinal axis between the distal end and proximal end of the nipple may have varying lateral cross section to simulate the anatomical features of a breast.

15. The nipple of claim 1, further comprising said nipple provided together with:

a fluid reservoir;

a fluid reservoir connector; or a fluid reservoir and a fluid connector.

16. The nipple of claim 15, wherein said fluid reservoir connector is configured to secure said nipple with said fluid reservoir.

17. The nipple of claim 15, further comprising said nipple provided together with:

a flow control mechanism configured to be used in fluid communication with said nipple.

* * * * *